US006557258B1

(12) United States Patent
Roberts et al.

(10) Patent No.: US 6,557,258 B1
(45) Date of Patent: May 6, 2003

(54) DUAL BLADE CUTTER

(76) Inventors: Elizabeth M. Roberts, 4015 Rock Hampton Dr., Tarzana, CA (US) 91356; Roger S. Hollister, 26017 Calmhill Dr., Torrance, CA (US) 90505

( * ) Notice: Subject to any disclaimer, the term of this patent is extended or adjusted under 35 U.S.C. 154(b) by 0 days.

(21) Appl. No.: 09/420,032

(22) Filed: Oct. 18, 1999

(51) Int. Cl.[7] ..... B26B 29/00
(52) U.S. Cl. ..... 30/1.5; 30/287
(58) Field of Search ..... 30/1.5, 287, 134, 30/135, 233, 282, 284, 285, 289, 299, 301, 304, 315, DIG. 3, DIG. 8, 124; 83/946, 857

(56) References Cited

U.S. PATENT DOCUMENTS

| | | | | | |
|---|---|---|---|---|---|
| 581,656 | A | * | 4/1897 | Butler | 30/233 |
| 633,736 | A | * | 9/1899 | Shoonover | 30/134 |
| 707,091 | A | * | 8/1902 | Dutton | 30/287 |
| 1,650,948 | A | * | 11/1927 | Long | 30/135 |
| 1,666,253 | A | * | 4/1928 | Blincoe | 30/135 |
| 2,490,414 | A | * | 12/1949 | Carney | 30/134 |
| 2,671,959 | A | * | 3/1954 | Silberhorn | 30/1.5 |
| 2,729,125 | A | * | 1/1956 | Krzanowski | 30/1.5 |
| 3,203,087 | A | * | 8/1965 | Jahn | 30/1.5 |
| 3,371,416 | A | * | 3/1968 | Horton | 30/233 |
| 3,392,447 | A | * | 7/1968 | Hendricks et al. | 30/124 |
| 3,474,533 | A | * | 10/1969 | Peck | 30/228 |
| 4,026,028 | A | * | 5/1977 | Green | 30/180 |
| 4,215,833 | A | * | 8/1980 | Chan | 30/315 |
| 4,247,983 | A | * | 2/1981 | Jansson et al. | 30/135 |
| 4,472,879 | A | * | 9/1984 | Sizemore, Jr. | 30/287 |
| 4,637,139 | A | * | 1/1987 | Chen | 30/1.5 |
| 4,852,255 | A | * | 8/1989 | Hochfeld | 30/91.2 |
| 5,235,748 | A | * | 8/1993 | Jahn | 30/1.5 |
| 5,333,381 | A | * | 8/1994 | Gelardi et al. | 30/1.5 |
| 5,653,023 | A | * | 8/1997 | Andina | 30/1.5 |
| 5,659,963 | A | * | 8/1997 | McCrady | 30/1.5 |

* cited by examiner

*Primary Examiner*—Kenneth E. Peterson
*Assistant Examiner*—Omar Flores-Sánchez
(74) *Attorney, Agent, or Firm*—Goldstein & Lavas, P.C.

(57) ABSTRACT

A cutter, for cutting various surfaces having various curvatures, having a blade assembly and a housing. The blade assembly includes a first blade and a second blade, each having an inner edge and an outer edge, and a guide mounted between the first blade and second blade adjacent to the inner edges thereof. The first blade has a first cutting surface and the second blade has a second cutting surface which are each oriented toward the guide. The first cutting surface is convex toward the guide and the second cutting surface is concave toward the guide, wherein the user may cut concave or convex surfaces by selectively using one of the blades.

6 Claims, 2 Drawing Sheets

DUAL BLADE CUTTER

BACKGROUND OF THE INVENTION

The invention relates to a dual blade cutter. More particularly, the invention relates to a cutter which has two blades, which together allow the cutter to follow and cut convex, concave, or flat objects, without cutting or gouging underlying surfaces.

Since the product tampering scares of the early '80s, nearly every potentially contaminable consumer product is now packaged using some type of tamper-proof or tamper-evident packaging. Typically such packaging includes a plastic wrapping which is heat-shrunk around the container cap.

To open the cap, the consumer must break or cut this wrapping. However, even though perforations or score marks are often provided in the wrapping, it is still difficult and often time consuming to fully remove the wrapping. In addition, women with long fingernails can find it impossible to break the wrapping without breaking a nail.

Conventional cutting tools are not well suited for cutting packaging. One common attempted technique is to straddle the bottle with a pair of open scissors. However, such a technique is usually unsuccessful in cutting the wrapping, might damage the underlying surface, or might lead to injury.

U.S. Pat. No. 5,740,612 to Takeshita et al. discloses a plastic bottle cutting implement which comprises a cylindrical ring which extends around the bottle, and a cutting implement directed toward the interior of the ring. Takeshita is only suitable for cutting bottles within a specific diameter range, and is not readily adaptable for cutting other curved surfaces.

U.S. Pat. No. 5,333,381 to Gelardi et al. discloses a wrap cutter which has wings which are separated by a ninety degree angle, and a cutting point therebetween. Gelardi et al. is particularly configured for cutting along the edgeof a package having right angles.

While these units may be suitable for the particular purpose employed, or for general use, they would not be as suitable for the purposes of the present invention as disclosed hereafter.

SUMMARY OF THE INVENTION

It is an object of the invention to produce a cutter which is particularly well suited for cutting curved packaging or curved bottle wrappings. Accordingly, two blades are provided which will follow both convex and concave objects according to the blade chosen by the user.

It is a further object of the invention to provide a cutter which maintains the blade at an ideal cutting angle. Accordingly a guard is positioned between the two blades, wherein the cutting surfaces of both blades ate oriented toward the guard which is particularly helpful in cutting thin, flexible, tough material, such as those commonly used in packaging applications.

It is a still further object of the invention that the cutter is safe, whereas its configuration minimizes the chance of injury to the user. Accordingly, the relative positioning of the guard and blades make direct punctures, relatively difficult, and make other injuries less likely. Further, the retractable blade feature allows the cutter to be safely stored and virtually eliminates the chances of injury when the cutter is not in use.

The invention is a cutter, for cutting various surfaces having various curvatures, having a blade assembly and a housing. The blade assembly includes a first blade and a second blade, each having an inner edge and an outer edge, and a guide mounted between the first blade and second blade adjacent to the inner edges thereof. The first blade has a first cutting surface and the second blade has a second cutting surface which are each oriented toward the guide. The first cutting surface is convex toward the guide and the second cutting surface, is concave toward the guide, wherein the user may cut concave or convex surfaces by selectively using one of the blades.

To the accomplishment of the above and, related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
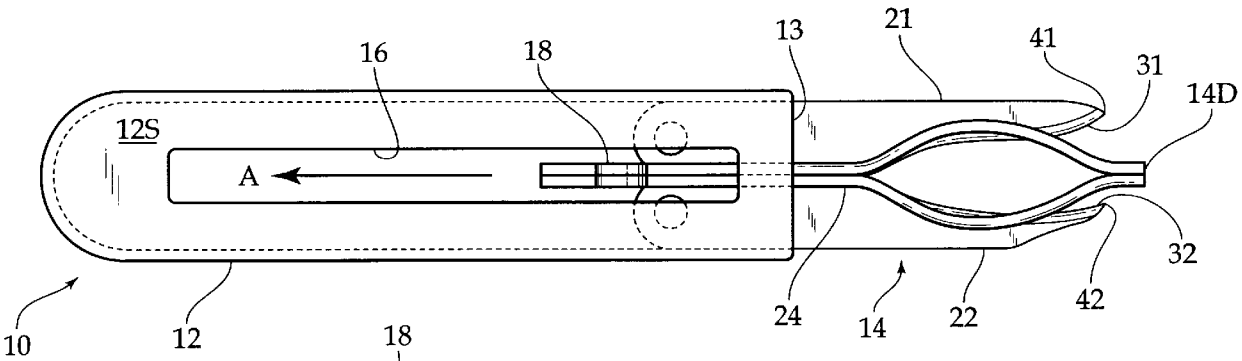
FIG. 1 is a side elevational view of the cutter with the blade assembly in the extended position, which is about to be retracted in the direction of arrow A.

FIG. 1 illustrates a cutter 10, comprising a housing 12 and a blade assembly 14. The housing 12 comprises an open end 13, and at least one side surface 12S having a side opening 16. The blade assembly 14 has an actuation lever 18 which extends through the side opening 16. The blade assembly 14 comprises a first blade 21, a second blade 22, and a guide 24. The blade assembly has a distal end 14D.

Illustrated in FIG. 1, blade assembly is shown in an extended position, wherein the distal end 14D of the blade assembly is extended beyond the open end 13 of the housing 12. The blade assembly 14 may also enter a retracted or storage position, wherein the actuation lever 18 is slid away from the open end 13 so that the blade assembly 14 is retracted fully into the housing wherein the distal end 14D of the blade assembly does not extend beyond the open end 13.

Each of the blades having a cutting surface—the first blade 21 has a first cutting surface 31, and the second blade 22 has a second cutting surface 32. In addition, the first blade 21 has a first blade tip 41 and the second blade 22 has a second blade tip 42. The guide 24 extends between the first blade 21 and second blade 22 wherein both the first cutting surface 31 and second cutting surface 32 are oriented toward the guide 24. Preferably the guide 24 extends slightly beyond both the first blade tip 41 and second blade tip 42.

Figure 2:
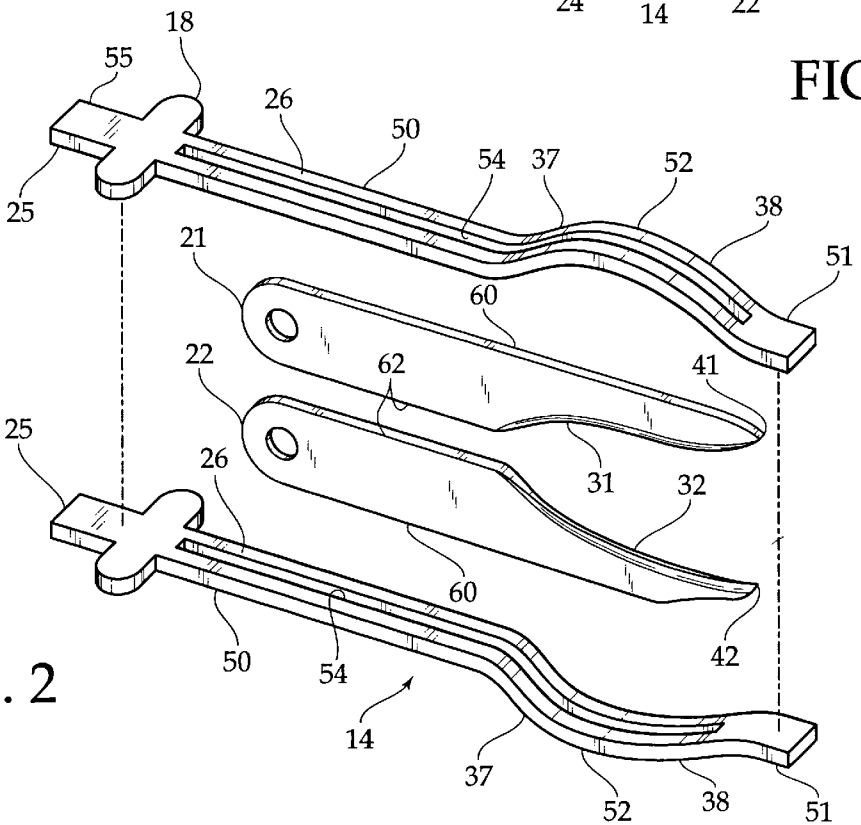
FIG. 2 is an exploded view of the various components of the blade assembly.

FIG. 2 details the components of the blade assembly 14. In particular, the guide 24 is a bipartite construction, comprising two guide halves 25. Each guide half 25 has a horizontal surface 26 which extends parallel to the horizontal surface 26 of the other blade half 25, and perpendicular to the first blade 21 and second blade 22. Each guide half 25 has a rear portion 50, a forward portion 51, and a buckle 52 between the rear portion 50 and forward portion, in which the horizontal surface 26 curves upward at a rising portion 37, and then downward at a falling portion 38 until the forward portion 51 is substantially coplanar with the rear portion 50 thereof. A central slot 54 extends longitudinally along the horizontal surface, along the rear portion 50 and the buckle 52. The central slot 54 is sized to allow the blades to extend therethrough wherein the central slot 54 is substantially the same in width as the blade thickness. Each guide half 25 may also have a back portion 55, which is not slotted, which has the actuation lever 18.

The blades 21 and 22 each have an outer edge 60 and an inner edge 62. The outer edge 60 and inner edge 62 are substantially parallel. The first cutting surface 31 and second cutting surface 32 extend from the inner edges 62, of the first cutting blade 21 and second cutting blade 22, respectively. The outer edges 60 of the first blade 21 and second blade 22 are curved toward the first blade tip 41 and second blade tip 42.

Figure 3:
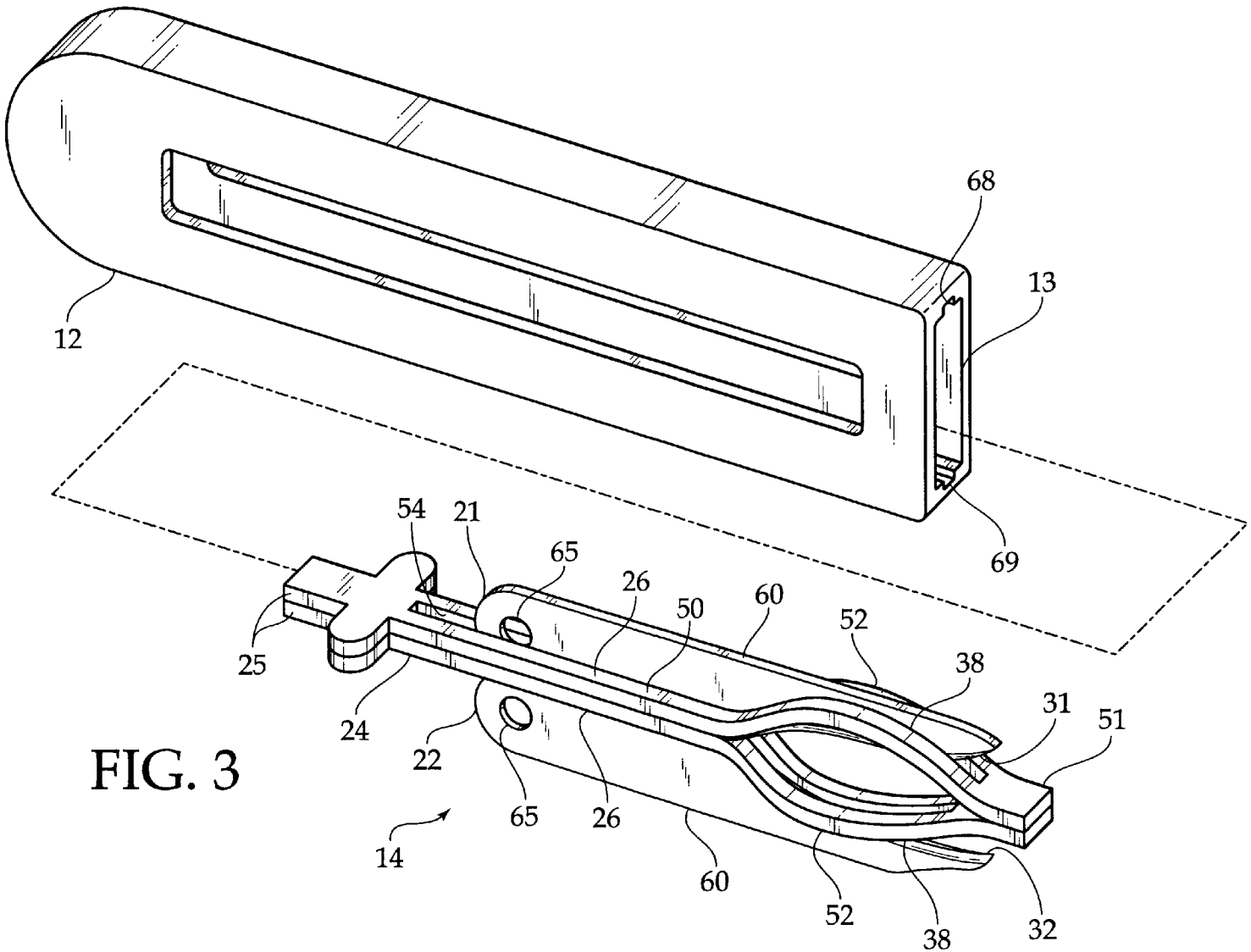
FIG. 3 is an exploded view of the cutter, showing the blade assembly fully assembled and ready to insert into the open end of the housing.

Referring to FIG. 3, when the blade assembly 14 is fully assembled, the first blade 21 and second blade 22 each extend perpendicular to the guide 24, and more particularly, each extend through the central slot 54 of one of the guide halves 25, wherein the first cutting surface 31 and second cutting surface 32 passes through the central slot 54 at the falling portion 38 of the buckle 52.

As seen in FIG. 3, the guides halves 25 are joined such that the horizontal surfaces 26 extend parallel to each other at the rear portion 50 and forward portion 51 thereof, and curve away from each other at the buckle 52. In general, the two guide halves are symmetrical. Also in FIG. 3, the blades each have a mounting hole 65. The mounting hole 65 may be used to secure the blades to the guide 24. The specific manner in which the blades are secured is unimportant, and various options therefor are well known. Thus, the discussion of the same is beyond the scope of this disclosure.

Also illustrated in FIG. 3, the open end 13 of the housing 12 has an upper slot 68 and a lower slot 69 for accommodating the outer edges 60 of the first blade 21 and second blade 22, respectively, and guiding said blades while the blade assembly 14 is retracted and extended.

The invention may be used like many other cutters, as it is not unlike a 'box cutter', which similarly employs an extendable and retractable static blade assembly 14. The use of such cutters in any given situation is best left to the common sense and ingenuity of the user. As previously stated, however, the cutter 10 according to the present invention has a guide 14, and two blades 21, 22—one convex, and one concave toward the guide—with both cutting surfaces 31, 32 oriented toward the guide for safety. The guide 14 further extends past the tips of the blades for additional safety, such that the guide 14 extends past the blade tips 41, 42 to allow objects intended to be cut to be positioned between one of the blades and the guide, while this orientation helps avoid injury to the user. When used with bottles having circumferential plastic packaging seals, for example, the bottle can be placed with a portion of the circumference of the bottle extending between the first blade tip 41 and the tip of the guide 14D. The bottle can be rotated so that the first blade surface 31 makes a circumferential cut on the bottle as it is rotated, while continued contact with the guide 14, 'guides' the bottle and keeps it against the first blade surface 31 as the bottle is rotated. This use will of course will be more suitable for certain bottles than others—according to their diameter, and the distance between the first blade tip 41 and the tip of the guide 14D. Alternatively, the cutter can be placed tangentially along the bottle, with the second blade tip 42 'picking' underneath packaging, perhaps wrapped around the neck of a bottle. Rotating the bottle while holding it against the guide tip 14D will allow such circumferential packaging to be cut, the guide tip 14D helps maintain the blade close to and substantially tangential to the bottle circumference. In such a use, the guide 14 saves the user from the alternative: the dangerous procedure often employed by people using ordinary cutting blades where a person undermines such packaging with a sharp cutting blade and then 'cuts outwards' toward themselves with the sharp blade! It should be clear however, that minimal experimentation with the cutter 10 by the user will reveal numerous techniques for effective cutting on curved surfaces of all kinds.

In conclusion, herein is presented a cutter which allows effective cutting of various curved surfaces through a combination of two blades and a guide mounted therebetween.

What is claimed is:

1. A cutter, comprising:

a first blade and a second blade, each of the blades having an outer edge and an inner edge, the first blade having a first cutting surface and the second blade having a second cutting surface;

a guide extending between the first cutting surface of the first blade and the second cutting surface of the second blade wherein both the first cutting surface and second cutting surface are oriented toward the guide;

wherein the first blade has a first blade tip and the second blade has a second blade tip, and wherein the guide extends beyond both the first blade tip and second blade tip; and wherein the first cutting surface is convex toward the guide near the first blade tip and the second cutting surface is concave toward the guide near the second blade tip.

2. The cutter as recited in claim 1, wherein the guide comprises two symmetrical guide halves, each guide half having a horizontal surface which extends parallel to the horizontal surface of the other guide half, each guide half having a rear portion, a forward portion, and a buckle between the rear portion and forward portion, a central slot extends longitudinally along the rear portion and buckle of each guide half, such that the first blade and second blade each extend through the central slot of one of the guide halves.

3. The cutter as recited in claim 2, wherein the first blade and second blade each extend perpendicular to the horizontal surfaces of the guide halves, wherein the buckle has a rising portion adjacent to the rear portion and a falling portion adjacent to the front portion, and wherein the first cutting surface and second cutting surface pass through the central slot at the falling portion of the buckle.

4. The cutter as recited in claim 3, wherein a blade assembly is formed by the rigid combination of the first blade, second blade, and the guide, the blade assembly having a distal end, and further comprising a housing having an open end, the blade assembly mounted within the housing such that the blade assembly selectively enters an extended position wherein the distal end of the blade assembly extends beyond the open end of the housing, and a retracted position wherein the distal end of the blade assembly does not extend beyond the open end of the housing.

5. The cutter as recited in claim 4, wherein the housing has at least one side surface having a side opening, and wherein the guide has a actuation lever which extends through the side opening and allows the blade assembly to be moved between the extended position and the retracted position.

6. The cutter as recited in claim 5, wherein the housing further has an upper slot and a lower slot extending longitudinally into the housing from the open end for accommodating the outer edges of the first blade and second blade, respectively, and guiding said blades while the blade assembly is retracted and extended.

* * * * *